US007866012B2

(12) United States Patent
Keyaki et al.

(10) Patent No.: US 7,866,012 B2
(45) Date of Patent: Jan. 11, 2011

(54) SLIDER FOR DOUBLE-SIDED SLIDE FASTENER WITH AUTOMATIC LOCKING DEVICE

(75) Inventors: Keiichi Keyaki, Kurobe (JP); Yoshikazu Hamada, Kurobe (JP); Koji Yamagishi, Kurobe (JP)

(73) Assignee: YKK Corporation, Tokyo (JP)

( * ) Notice: Subject to any disclaimer, the term of this patent is extended or adjusted under 35 U.S.C. 154(b) by 172 days.

(21) Appl. No.: 12/051,574

(22) Filed: Mar. 19, 2008

(65) Prior Publication Data

US 2008/0229555 A1 Sep. 25, 2008

(30) Foreign Application Priority Data

Mar. 20, 2007 (JP) ..... P2007-073166

(51) Int. Cl.
*A44B 19/30* (2006.01)
*A44B 19/26* (2006.01)

(52) U.S. Cl. ..... 24/422; 24/415; 24/418

(58) Field of Classification Search ..... 24/420, 24/421, 422, 423, 424, 425, 417, 418, 419, 24/436

See application file for complete search history.

(56) References Cited

U.S. PATENT DOCUMENTS

| | | | | |
|---|---|---|---|---|
| 2,405,875 | A * | 8/1946 | Carlile | 24/422 |
| 2,423,210 | A * | 7/1947 | Ulrich et al. | 24/422 |
| 2,657,444 | A * | 11/1953 | Bashover | 24/422 |
| 2,799,070 | A * | 7/1957 | Weber | 24/422 |
| 2,839,806 | A * | 6/1958 | Moser | 24/424 |
| 2,953,831 | A * | 9/1960 | Morin | 24/422 |
| 3,038,227 | A * | 6/1962 | Godfrey et al. | 24/422 |
| 3,255,505 | A * | 6/1966 | Moser | 24/423 |
| 3,729,781 | A * | 5/1973 | Fukuroi | 24/424 |
| 4,667,376 | A * | 5/1987 | Ishii et al. | 24/421 |
| 7,017,242 | B2 | 3/2006 | Bernasconi | |
| 7,225,509 | B2 | 6/2007 | Bernasconi | |
| 2003/0056342 | A1 | 3/2003 | Iwase et al. | |

FOREIGN PATENT DOCUMENTS

| | | |
|---|---|---|
| JP | UM-Y2-56-37606 | 9/1981 |
| JP | A-2003-93116 | 4/2003 |

OTHER PUBLICATIONS

Office Action of corresponding Chinese Application No. 2008100857531, dated May 8, 2009.

* cited by examiner

*Primary Examiner*—Robert J Sandy
*Assistant Examiner*—Michael Lee
(74) *Attorney, Agent, or Firm*—Alston & Bird LLP

(57) ABSTRACT

A slider for a double-sided slide fastener includes: a body, having a first body, a second body opposed to the first body, an operating member, having a first member parallel to the first body and formed with a first groove and a second member parallel to the second body and formed with a second groove, and adapted to slide on the first and second bodies in a direction; a pawl member having a locking pawl configured to retractably project to a space of the body in accordance with a sliding operation of the operating member; and first and second pull-tabs, attached to the first and second grooves, respectively. A shaft portion of the first pull-tab can abut against an end portion of the first groove in the direction, and a shaft portion of the second pull-tab can abut against an end portion of the second groove in the direction.

2 Claims, 6 Drawing Sheets

SLIDER FOR DOUBLE-SIDED SLIDE FASTENER WITH AUTOMATIC LOCKING DEVICE

CROSS-REFERENCE TO RELATED APPLICATIONS

This application claims priority to Japanese Application No. 2007-073166, filed Mar. 20, 2007, which is hereby incorporated herein in its entirety by reference.

BACKGROUND OF THE INVENTION

The present invention relates to a slider for a double-sided slide fastener with an automatic locking mechanism that is configured by individually attaching pull-tabs, which can cause a slider to perform a sliding operation backward and forward, to both the front surface and the rear surface of the body of the slider, that can perform an opening operation and a closing operation from outside and inside, and that can stop and fix the slider at and to a given place.

There is a related-art double-sided double-pull-tab slider that is configured to have two pull-tabs 100, 101 respectively provided on the front side and the rear side of a slider body 102, as follows (refer to JP-UM-Y2-56-37606). That is, as illustrate in FIG. 12, a swinging element 103 having a locking pawl 105 and a link member 106, which are respectively protrudingly provided at one end thereof and at the other end thereof, is fit into the body so that the link member 106 and the locking pawl 105 are fit into a forward-side portion and a backward-side portion at the front surface side of the body, i.e., a shoulder portion 107 and a back portion 108. Another swinging element 104 having only a link member 106 protrudingly provided at one end thereof without being provided with a locking pawl at the other end thereof is fit into the rear surface side of the body 102. The upper and lower link members 106 are associated with each other by being inserted into a groove hole 123 bored in a guide post 109 so as to penetrate therethrough. When the front-side pull-tab 100 is pulled, the upper swinging element 103 is pulled up so as to retreat the locking pawl 105 from an element guide groove 110. When the rear-side pull-tab 101 is pulled, the lower swinging element 104 is pulled up so as to simultaneously press the upper swinging element 103 and as to retreat the locking pawl 105 from the element guide groove 110. Also, there has been known a pull-tab turn type slider configured, as follows (refer to JP-A-2003-93116). That is, as illustrated in FIGS. 13 and 14, a U-shaped guide member 113 is provided in a body 112 so that a pull-tab 111 can turn along the forward surface of each of an upper plate, a lower plate, and a guide post 114 of the body 112. A U-shaped pull-tab guide portion 115 is provided along the inner side of the U-shaped guide member 113. One pull-tab 111 is turnably mounted in the pull-tab guide portion 115. A protruding piece 118 of a locking member 116 is inserted into an elongated hole 121 provided in the U-shaped guide member 113. Then, the pull-tab 111 is pulled along the pull-tab guide portion 115 of the U-shaped guide member 113 to a shoulder side (the left side, as viewed in FIG. 14) of the body 112. At that time, the U-shaped guide member 113 pushes a spring 122 incorporated in the body 112 by a hook piece 119 of the locking member 116 so as to retreat the locking pawl 117 of the locking member 116 from an element guide groove 120. Thus, the slider body 112 can be slid backward and forward.

The double-sided double-pull-tab slider, which has been described and illustrated in FIG. 12, is configured so that the locking pawl 105 is retreated from the element guide groove 110 through the swinging element 103 (104), to which the pull-tab 100 (101) is attached, so as to slide the slider. Therefore, the number of components of the slider is large. The structure of the slider is complex. Especially, when the pull-tab 101 provided at the rear surface side of the body 102 is operated, the locking pawl 105 is retreated and slid through the swinging element 104. Thus, an operation of releasing the front-side locking mechanism by the front-side pull-tab 100 at the front surface side of the slider differs from that of releasing the rear-side locking mechanism by the rear-side pull-tab 101 at the rear surface side thereof. Precision is required to operate both the front-side locking mechanism and the rear-side locking mechanism at the same efficiency. The double-sided double-pull-tab slider illustrated in FIG. 12 has a problem in this regard.

The pull-tab turn type sliders illustrated in FIGS. 13 and 14 are convenient when the single pull-tab 111 is operated by being turned frontwardly and rearwardly. However, the pull-tab turn type sliders illustrated in FIGS. 13 and 14 are inconvenient when it is necessary to operate a fastener chain individually from the outside and the inside thereof. For example, when an operation of closing a fastener chain is performed from the outside of a doorway of a tent, the pull-tab 111 is placed outside the tent. Thus, an operation of opening the fastener chain from the inside of the tent cannot be performed. The pull-tab turn type sliders illustrated in FIGS. 13 and 14 have a problem in this regard.

BRIEF SUMMARY OF VARIOUS EMBODIMENTS OF THE INVENTION

It is therefore an object of the invention to provide a slider for a double-sided slide fastener with an automatic locking mechanism, which can be operated utilizing individually the front-side and rear-side pull-tabs and in which, when the pull-tabs are operated, each of the pull-tabs can stop at a predetermined position in the slider and can exercise stable sliding and stopping functions.

In order to achieve the object, according to the invention, there is provided a slider for a double-sided slide fastener with an automatic locking device, comprising:

a body, having a first body, a second body opposed to the first body, and a third body connected to the first body and the second body, wherein the first body, the second body, and the third body define a space;

an operating member, attached to the body, and having a first member being parallel to the first body and formed with a first groove and a second member being parallel to the second body and formed with a second groove, the operating member adapted to slide on the first member and the second member in a direction;

a pawl member, being in the body, and having a locking pawl configured to retractably project to the space in accordance with a sliding operation of the operating member;

a first pull-tab, attached to the first groove; and a second pull-tab, attached to the second groove, wherein a shaft portion of the first pull-tab can abut against an end portion of the first groove in the direction, and a shaft portion of the second pull-tab can abut against an end portion of the second groove in the direction.

The first groove may have a linear shape and be parallel to the first body, and the second groove may have a linear shape and be parallel to the second body.

A position of the end portion of the first groove and a position of the end portion of the second groove may be shifted with each other in the direction. The third body of the body may include a first part close to the first body and a second part close to the second body. The third body may have a carved shape and a curvature of the second part and a curvature of the third part may be different from each other. The operation member may have a third member connected to the first member and the second member. The third member may include a third part close to the first member and a fourth part close to the second member. The third member may have a carved shape and a curvature of the third part and a curvature of the fourth part may be different from each other.

The third body of the body may include a sliding groove. The operation member may have a third member connected to the first member and the second member. The third member may include a sliding concave portion having a thickness substantially equal to that of each of the first and second grooves and adapted to fit into and slide in the sliding groove.

The end portions of the first and second grooves and the sliding concave portion may be non-continuously connected to each other.

DETAILED DESCRIPTION OF VARIOUS EMBODIMENTS

Figure 1:
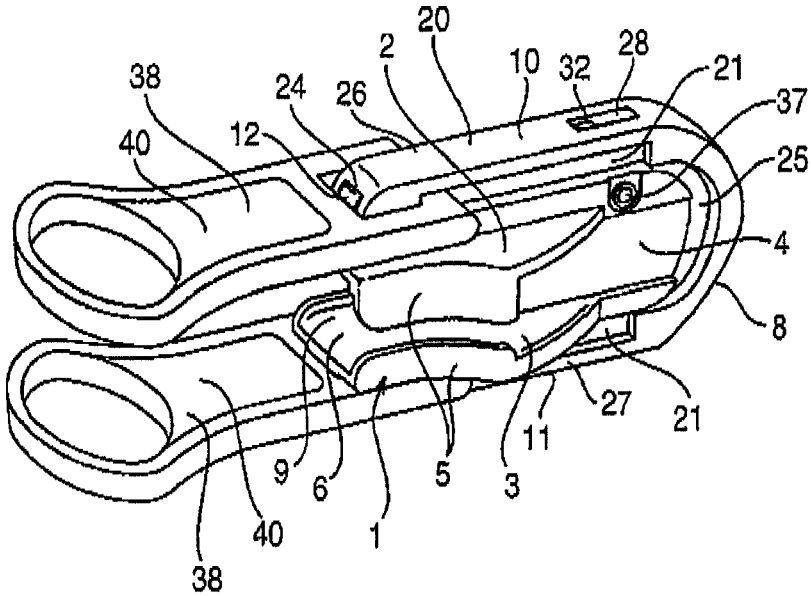
FIG. 1 is a perspective view illustrating a double pull-tab slider for a double-sided slide fastener with an automatic locking device according to an embodiment of the invention.
Figure 2:
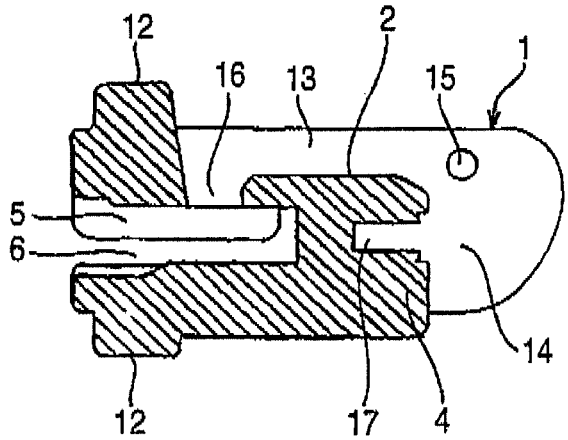
FIG. 2 is a cross-sectional view illustrating a body of the slider.

A slider for a double-sided slide fastener with an automatic locking mechanism according to the invention includes a body 1, an operating member 20, a pawl member 30, and pull-tabs 38 that are respectively provided at the front side 10 and the rear side 11 of the operating member 20, as illustrated in FIGS. 1 to 6. These members are made of metal as illustrated in FIG. 2; the body 1 is configured so that an upper plate 2 and a lower plate 3 are connected by a guidepost 4. Flanges 5 are bendingly and respectively provided on both sides in a width direction of each of the upper plate 2 and the lower plate 3. A substantially-Y-shaped element guide groove 6 is provided so as to be surrounded by the flanges 5 (the plates 2 and 3) and the guide post 4. The guide post 4 is extended toward a forward surface (the side of a shoulder portion 8) of the body 1, and a sliding groove 14 is provided in the extended part of the guide post 4 so as to penetrate through the extended part in a front-rear direction (an up-down direction, as viewed in FIG. 2). A cross-sectionally T-shaped projecting portion 12 is provided at the side of a back portion 9 of each of the upper plate 2 and the lower plate 3. A projecting ridge portion 13 extending in the anteroposterior direction is provided on the center of the upper plate so as to protrude therefrom. A pin hole 15 is provided in a forward side part of the projecting ridge portion 13. A pawl hole 16, into which a locking pawl 31 of the pawl member 30 is fit, is formed in a part of the upper plate 2, which is provided at the side of the back portion 9. A spring housing portion 17 is provided in a central part of the forward surface of the guide post 4, which is located at the side of the shoulder portion 8 and faces the sliding groove 14.

The projecting portion 12 of the body 1 and the operating member 20, which is fit into the sliding groove 14 and is cross-sectionally U-shaped as a whole, are formed as follows.

Figure 3:
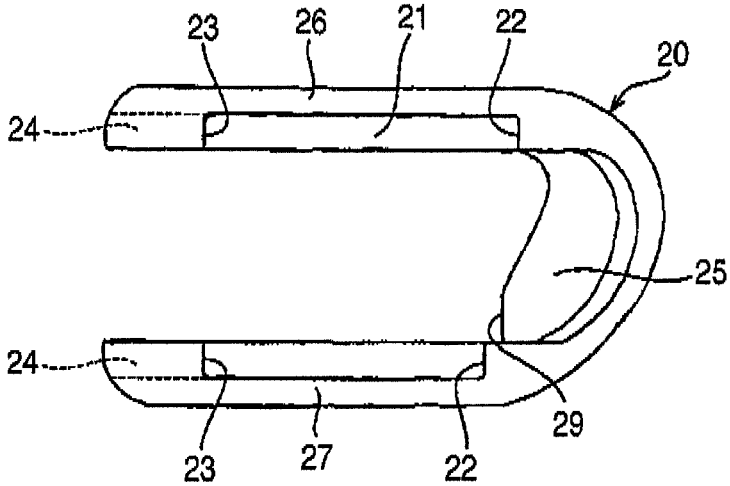
FIG. 3 is a front view illustrating an operating member of the slider.

As illustrated in FIG. 3, a pull-tab guide groove 21, in which the pull-tab 38 can linearly slide, is concavely formed in a side surface of each of an upper piece 26 and a lower piece 27. A forward end portion 22 and a backward end portion 23, which regulate a sliding operation of the associated pull-tab 38, are provided at the forward end and the backward end of each of the pull-tab guide grooves 21. The forward end portions 22 respectively provided in the upper piece 26 and the lower piece 27 are configured so that the forward end portion 22 provided in the upper piece 26 protrudes (is shifted) more forwardly than the front end portion 22 provided in the lower piece 27. The forward end portions 22 respectively provided in the upper piece 26 and the lower piece 27 differ in the setting position from each other. Accordingly, the forward surface of the operating member 20 is formed into a streamline shape in which an upper-piece-side part of the forward surface thereof protrudes. Similarly, the forward surface of the body 1 is formed into a streamline shape. A sliding concave portion 25, which can be housed in the sliding groove 14 provided in the body 1, is provided in a forward side part of the operating member 20. A cam portion 29 is formed in an inside lower portion of the sliding concave portion 25 and can press a pressing piece 33 of the pawl member 30. A top elongated hole portion 28 corresponding to a pin hole 15 formed in the body 1 is provided in the upper piece 26 so that a projecting piece 32 of the pawl member 30 can be fit into the elongated hole portion 28 by insertion. Cross-sectionally T-shaped attaching grooves 24 are provided in end portions of the upper piece 26 and the lower piece 27 of the operating member 20 so that the projecting portions 12 provided at the side of the back portion 9 of the body 1 can be fit into the attaching grooves 24, respectively.

Figure 4:
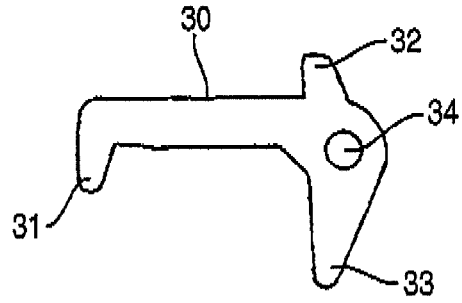
FIG. 4 is a front view illustrating a pawl member of the slider.

As illustrated in FIG. 4, the pawl member 30 is provided with the locking pawl 31 at one end thereof and with the projecting piece 32 protruding upwardly and the pressing piece 33 protruding downwardly at the other end thereof. A pin hole 34 is formed in an intermediate portion between the projecting piece 32 and the pressing piece 33. The pin hole 34 is aligned with the pin hole 15 provided in the body 1, so that the pawl member 30 is rotatably supported by the pin 37. The locking pawl 31 is fit into the pawl hole 16 provided in the body 1 by insertion. The projecting piece 32 is fit into the hole portion 28 provided in the operating member 20. The pressing piece 33 abuts against the coil-like spring 36, which is fit into the spring housing portion 17 of the body 1 by insertion, so as to be able to press the spring 36.

As illustrated in FIG. 1, each of the pull-tabs 38 has a grip portion 40 provided at one end thereof and hook-like shaft portions 39 oppositely provided at the other end thereof. The pull-tabs 38 are attached to the slider by fitting the pull-tab 38 provided at the side of the front surface 10 and the pull-tab 38 provided at the side of the rear surface 11, into the pull-tab guide grooves 21 concavely and respectively provided in the upper piece 26 and the lower piece 27 of the operating member 20.

Figure 7:
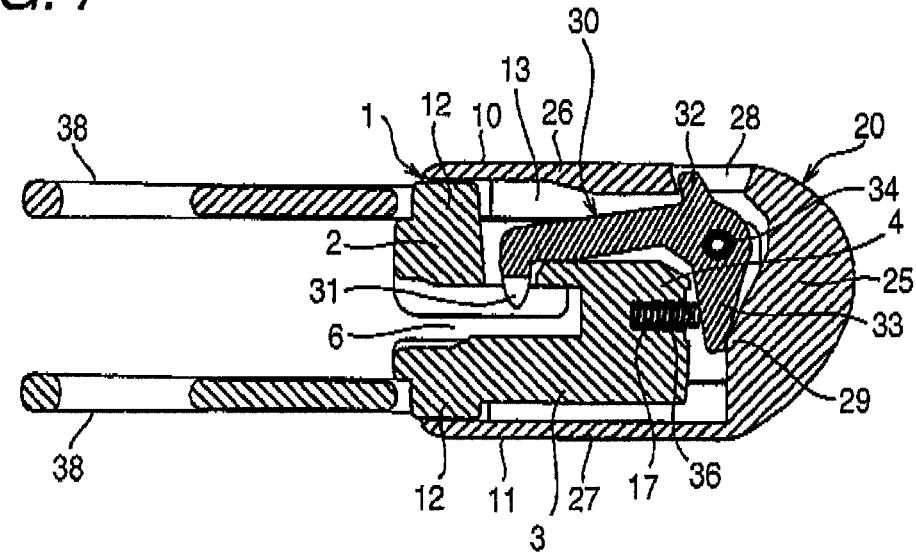
FIG. 7 is a cross-sectional view of the slider in a locked state, for illustrating an operation thereof.

A specified mode of a slider for a double-sided slide fastener with an automatic locking mechanism according to the invention, which is fabricated by arranging each member at a predetermined position, is described below. In a normal state in which no pulling force acts upon each of the pull-tab 38 provided at the side of the front surface 10 and the pull-tab 38 provided at the side of the rear surface 11, the pawl member 30 forwardly presses the pressing piece 33 with an elastic force of the spring 36, as illustrated in FIG. 7. Consequently, the locking pawl 31 advances to the element guide groove 6 provided in the body 1. Then, the locking pawl 31 is caught in the fastener element. Thus, an operation of sliding the slider cannot be performed. Accordingly, the slider is put into a stopped state.

Figure 8:
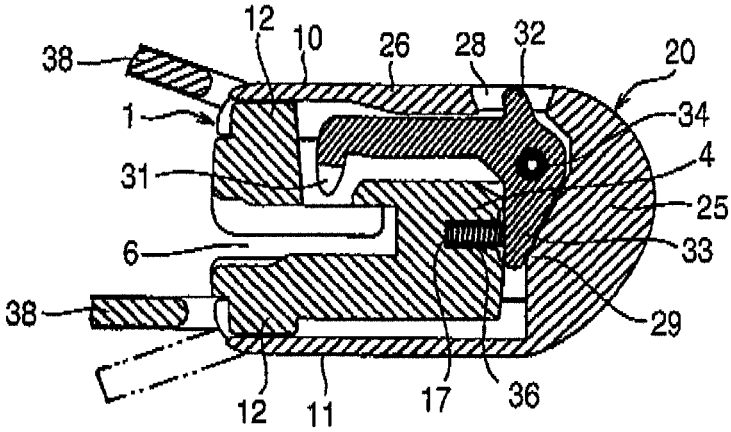
FIG. 8 is a cross-sectional view of the slider in a state, in which a pull-tab is pulled to a rear-portion side, for illustrating an operation thereof.

Next, when the pull-tab 38 provided at the side of the front surface 10 or the pull-tab 38 (represented by chain double-dashed lines) provided at the side the rear surface 11 is pulled toward the back portion 9 of the body 1 or toward the backward end portion 23 of the operating member 20, as illustrated in FIG. 8, the pressing piece 33 of the pawl member 30 is pressed by the cam portion 29 provided in the operating member 20. In addition, the spring 36 is compressed, so that the locking pawl 31 of the pawl member 30 can be retreated from the element guide groove 6 of the body 1, that the slider can be slid in a direction in which the fastener chain is opened, and that the fastener chain can be opened.

Figure 9:
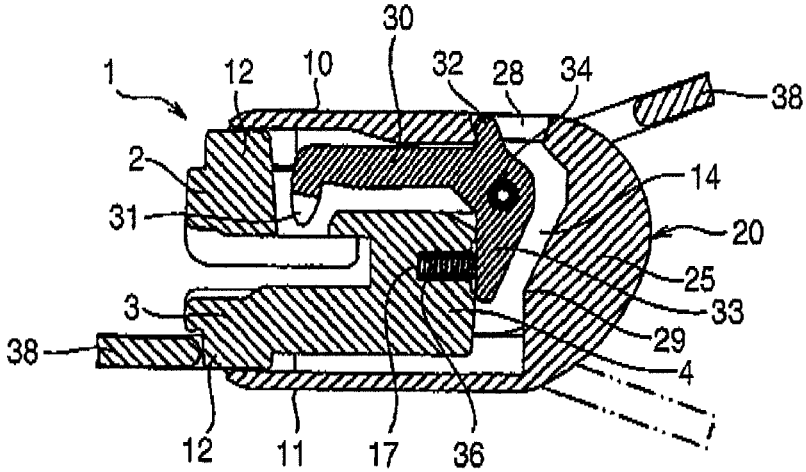
FIG. 9 is a cross-sectional view of the slider in a state, in which a pull-tab is pulled to a shoulder-portion side, for illustrating an operation thereof.

Further, when the pull-tab 38 provided at the side of the front surface 10 or the pull-tab 38 (represented by chain double-dashed lines) provided at the side the rear surface 11 is pulled toward the shoulder portion 8 of the body 1 or toward the forward end portion 23 of the operating member 20, as illustrated in FIG. 9, the operating member 20 slides. The projecting piece 32 of the pawl member 30 is pressed through the hole portion 28 provided in the upper piece 26 of the operating member 20, while the pull-tab 38 is turned. Consequently, the spring 36 is compressed so as to retreat the locking pawl 31 from the element guide groove 6 provided in the body 1, and to cause the slider to slide in a direction in which the fastener chain is closed. Accordingly, the fastener chain is closed.

Figure 10:
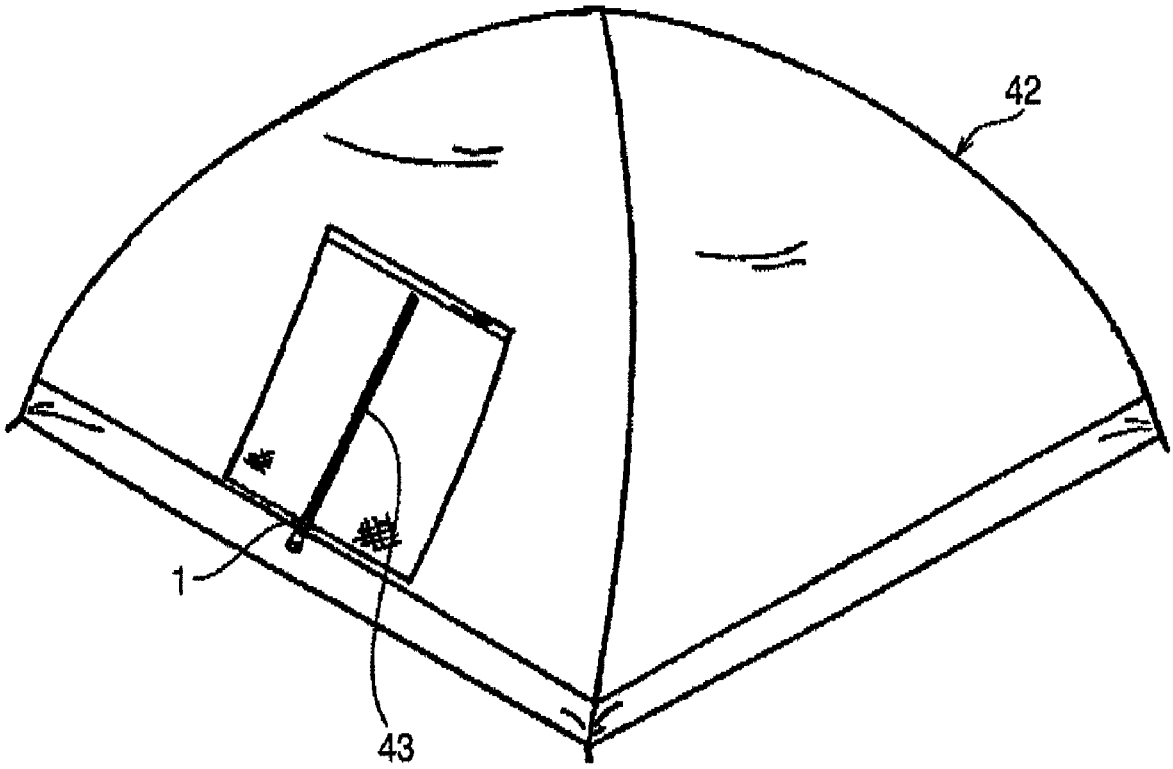
FIG. 10 is a general view illustrating a tent whose doorway uses the slider.
Figure 11:
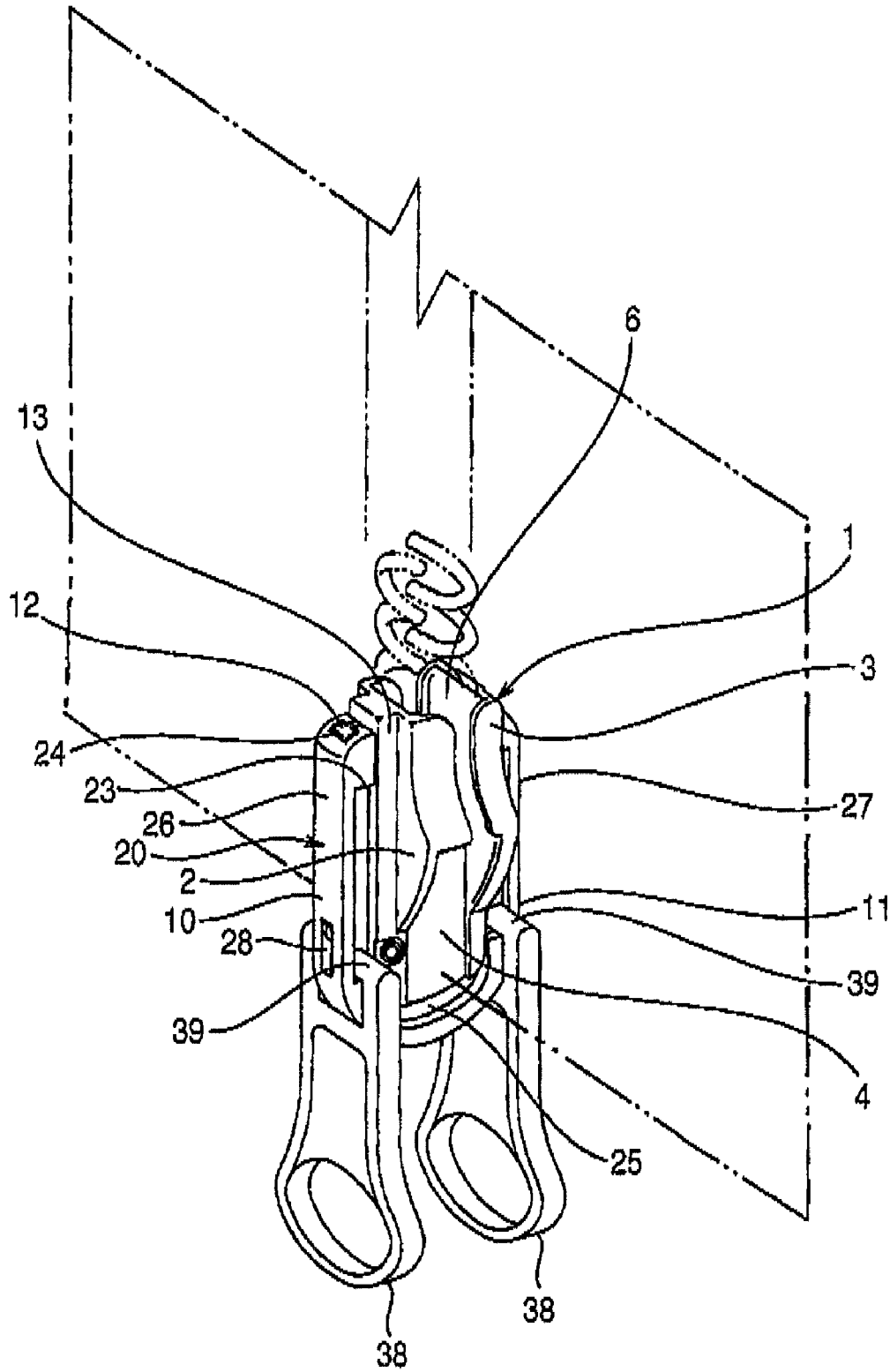
FIG. 11 is a state view illustrating a state in which the slider is attached to a fastener chain and in which pull-tabs are caused to hang therefrom.
Figure 12:
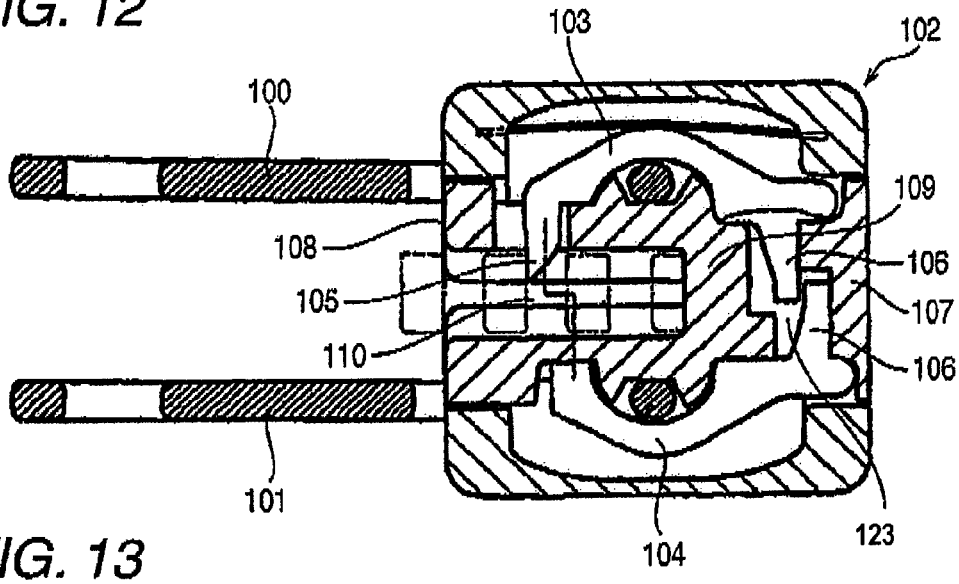
FIG. 12 is a cross-sectional view illustrating a related-art double-sided double pull-tab slider with an automatic locking device.
Figure 13:
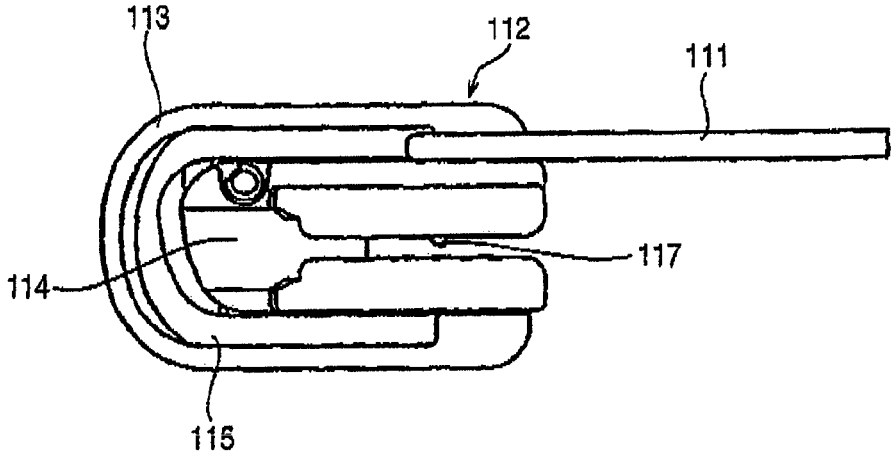
FIG. 13 is a front view illustrating a related-art pull-tab turn type slider.
Figure 14:
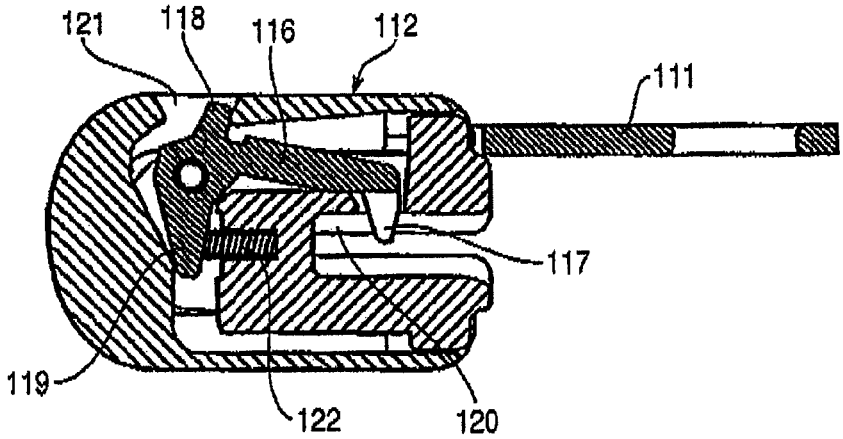
FIG. 14 is a cross-sectional view illustrating the related-art pull-tab turn type slider.

A case, in which the slider for a double-sided slide fastener with an automatic locking mechanism according to the invention is used by being attached to an opening/closing portion 43 of a doorway of a tent 42, as illustrated in FIGS. 10 and 11, is described below. In a case where a fastener chain is attached to the opening/closing portion 43 so that the slider is placed at a lower portion of the tent 42 when the fastener chain is closed, a person being present in the tent 42 can open the fastener chain and the opening/closing portion 43 by grasping and upwardly pulling an inside pull-tab of the slider even when a person having come out of the tent 42 closes the opening/closing portion 43 from the outside of the tent 42. In a case where a person being present in the tent 42 closes the fastener chain, a person being present outside the tent 42 can open the fastener chain and the opening/closing portion 43 by grasping and upwardly pulling an outside pull-tab of the slider. In the case of using the related-art pull-tab turn type slider, the pull-tab of the slider is placed only outside or inside the tent. Thus, in such a state, the related-art pull-tab turn type slider cannot be utilized.

As described in the foregoing section, a slider for a double-sided slide fastener with an automatic locking mechanism according to the invention, which has pull-tabs 38 respectively provided at the front side and the rear side thereof, includes a body 1, an operating member 20, a locking member 30, a spring 36, and pulls that include the pull-tabs 38 respectively provided at the front side and the rear side of the body 1, as illustrated in FIGS. 1 and 7. These members are made of metal. Each of the body 1, the operating member 20, and the pull-tabs 38 is formed by die-cast molding of a zinc alloy or an aluminum alloy. The pawl member 30 is formed by press-molding of a copper alloy or stainless steel.

The body 1 is configured so that the upper plate 2 and the lower plate 3 are connected by the guide post 4 at the side of the shoulder portion 8 in the up-down direction, as viewed in FIG. 2. The flanges 5 are bendingly provided on both side edge portions of each of the upper plate 2 and the lower plate 3 in an inward direction in which the flanges 5 are arranged close to each other. Relatively higher flanges are formed as the flanges 5 of the upper plate 2. Relatively lower flanges are formed as the flanges 5 of the lower plate 3. The substantially Y-shaped element guide groove 6 for guiding a coil-like fastener element, is provided, which is surrounded by the flanges 5 (the upper plate 2 and the lower plate 3) and the guide post 4. Incidentally, in a case where the upper plate 2 is formed at the side of the front surface 10, and where the lower plate 3 is formed at the side of the rear surface 11, the flanges 5 of the upper plate 2 can be formed so as to have the same height as those of the flanges of the lower plate 3 so as to form the element guide groove 6 suited to a monolithic metal element or to a resin injection-molded element.

The forward surface of the guide post 4 of the body 1 is extended forwardly. A sliding groove 14 is provided, which entirely penetrates through the extended part of the guide post 4 in the front-rear direction, i.e., the up-down direction, as viewed in FIG. 2. The term "the extended part" designates a part of the guide post 4, which is located more forwardly than the shoulder portion 8 of the upper plate 2 and the lower plate 3. The low projecting ridge portion 13 is provided on the center of the surface of the upper plate 2 over the entire length of the guide post 4 including the extended part. The cross-sectionally T-shaped projecting portion 12 is provided on the projecting ridge portion 13 at a predetermined place at the side of a back portion 9 of the upper plate 2 so as to protrude therefrom. A cutout portion is formed in the center of the projecting ridge portion 13 over the entire length thereof from the projecting ridge portion 12 to the shoulder portion 8 so that the pawl member 30 can be fit into the cutout portion. The circular pin hole 15 is provided in the forward side part of the projecting ridge portion 13, i.e., the extended part so as to penetrate therethrough in a width direction. The pawl hole 16, into which the locking claw 31 of the pawl member 30 can be fit, is provided in a base part of the projecting portion 12 at the side of the back portion 9 of the body 1 so as to be directed to the element guide groove 6 and as to penetrate therethrough. The spring housing portion 17 capable of housing the coil-like spring 36 is provided at a part that is located at the center in the width direction of the forward surface of the guide post 4, i.e., the shoulder portion 8 and that faces the sliding groove 14 Similarly to the upper plate 2, the lower plate 3 is provided with the cross-sectionally T-shaped projecting portion 12 that is formed at a predetermined place at the side of the back portion 9 of the lower plate 3 so as to protrude toward the front surface of the body 1.

The operating member 20 is held in contact with the upper plate 2, the forward surface of the extended part, and the lower plate 3, and is opened at one end thereof. The entire operating member 20 is U-shaped and has the upper piece 26, which is parallel to the upper plate 2 and is provided at the side of the front surface 10, and the lower piece 27 which is parallel to the lower plate 2 and is provided at the side of the rear surface 11. The upper piece 26 is connected to the lower piece 27 by a curved portion. The operating member 20 is formed to have a width dimension nearly equal to that of the extended part of the guide post 4 of the body 1 so as to be able to cover the extended part. The operating member 20 is fit onto the projecting portion 12 provided at the side opposite to the side of the shoulder portion 8 of the body 1 and at the side of the back portion of each of the upper plate 2 and the lower plate 3 and is fit onto the sliding groove 14 provided in the forward surface portion of the body 1 so that the body 1 can slide backward and forward. As illustrated in FIG. 3, the operating member 20 is provided with the pull-tab guide grooves 21 which are concavely cut in the side surfaces of the upper piece 26 and the lower piece 27 so that the pull-tabs 38 can linearly move along the pull-tab guide grooves 21. The forward end portion 22 and the backward end portion 23 for regulating sliding operations of the pull-tabs 38 are provided at the forward end and the backward end of each of the pull-tab guide grooves 21 and are projected more than the sliding groove 14 in the width direction.

Figure 5:
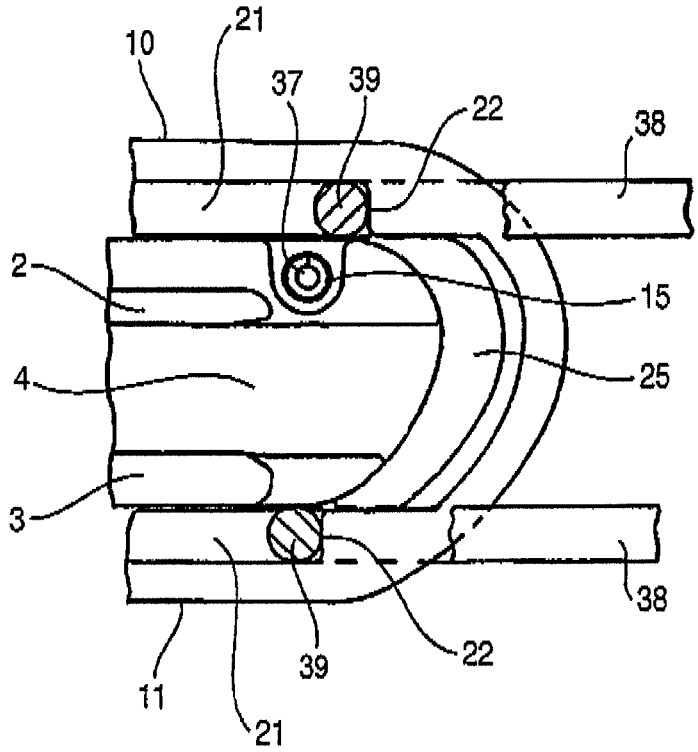
FIG. 5 is a partially enlarged view illustrating a front-side portion of the slider.

The pull-tab guide grooves 21 are respectively formed on both sides in the direction of the width of the operating member 20 so as to be lower than the front side surface of the operating member 20 and as to be smaller in width than the extended part of the body 1. As illustrated in FIG. 5, the forward end portion 22 of the upper piece 26 and the forward end portion 22 of the lower piece 27 are provided so that the forward end portion 22 of the upper piece 26 is projected (shifted) more forwardly than the forward end portion 22 of the lower piece 27. The forward end portion 22 of the upper piece 26 differs in the setting position in the anteroposterior direction from the forward end portion 22 of the lower piece 27. That is, because the backward end portion 23 of the upper piece 26 is, set to be equal in the setting position in the anteroposterior direction to the backward end portion 23 of the lower piece 27, the pull-tab guide grooves 21 are formed so that the length of the pull-tab guide groove 21 provided in the upper piece 26 is larger than the length of the pull-tab guide groove 21 provided in the lower piece 27. Accordingly, the curved portion provided as the forward surface portion of the operating member 20 is shaped so that the crowning point of the curved portion formed into a streamline shape, whose upper part is protruded as viewed in FIG. 3, is located to the side of the upper plate 2. The forward portion of the extended part of the body 1 is formed into a similar streamline shape.

When the pull-tab 38 is laid down forwardly in a state in which the shaft portion 39 (to be described later) of the pull-tab 38 abuts against the forward end portion 22 of the pull-tab guide groove 21, a parallel gap is produced between the pull-tab 38 and the operating member 20 even in a case where the forward end portions 22 provided in the upper piece 26 differ in the setting position from those 22 provided in the lower piece 27. This can be achieved by setting a dimension from the forward end surface of the forward end portion 22 to the forward end surface of the operating member 20 to be smaller than the distance between the shaft portion 39 and the grip portion 40 of each of the pull-tabs 38. Because the same pull-tabs are utilized at the front side and the rear side of the body, the forward ends of the pull-tabs 38 laid down forwardly can be set to differ in the position in the anteroposterior direction from each other (i.e., the forward ends of the pull-tabs 38 respectively provided at the front side and the rear side of the body 1 differ in the position in the posterior direction from each other). The aforementioned example is only a preferable embodiment of the invention. The setting positions in the anteroposterior direction of the forward end portions 22 can be set to be equal to each other. In this case, the forward end portion of the extended part of the body 1 and a forward end part of the operating member can be shaped so as to have the same curvature.

Figure 6:
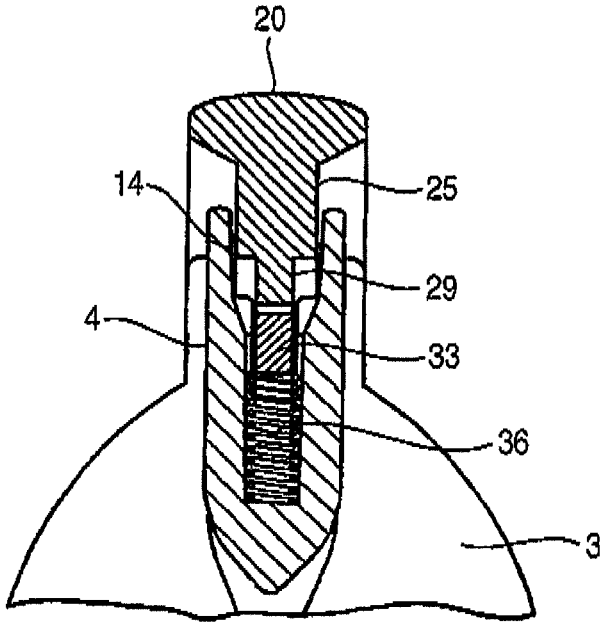
FIG. 6 is a partially cross-sectional view illustrating the front-side portion of the slider.

The sliding concave portion 25, which can be housed in the sliding groove 14 of the body 1 is provided in the forwardly inner side of the operating member 20. The sliding concave portion 25 has a thickness substantially equal to that in the width direction of the pull-tab guide groove 21. As illustrated in FIG. 6, the operating member 20 is cross-sectionally T-shaped. The sliding concave portion 25 is accommodated in the sliding groove 14 formed in the extended part of the body 1. The cam portion 29 protruding inwardly to the inwardly lower part of the sliding concave portion 25 is provided at a part at which the sliding concave portion 25 is slide-contacted with the inner surface of the sliding groove 14. The pressing piece 33 provided in the pawl member 30 is pressed by the cam portion 29. The elongated hole portion 28 is provided in the upper piece 26 above the pin hole 15 that is provided in the body 1. The elongated hole portion 28 is formed into a shape so into which the projecting piece 32 of the pawl member 30 can be fit by insertion. Cross-sectionally T-shaped attaching grooves 24 are respectively provided in the inner surfaces of the end portions of the upper piece 26 and the lower piece 27 of the operating member 20.

As illustrated in FIG. 4, the pawl member 30 is provided with the locking member 31 at one end thereof and with the projecting piece 32 protruding upwardly and the pressing piece 33 protruding downwardly at the other end thereof. A pin hole 34 is formed in an intermediate portion between the projecting piece 32 and the pressing piece 33. The pin hole 34 is aligned with the pin hole 15 provided in the body 1, so that the pawl member 30 is rotatably supported by the pin 37. The locking pawl 31 is fit into the pawl hole 16 provided in the body 1 by insertion. Normally, the locking pawl 31 protrudes toward the element guide groove 6. Then, the locking pawl 31 is fixed by being caught in the fastener element. The projecting piece 32, which protrudes upwardly as viewed in FIG. 4, is fit into the hole portion 28 provided in the operating member 20 to thereby regulate an operation of the operating member 20. The pressing piece 33 abuts against the coil-like spring 36, which is fit into the spring housing portion 17 of the body 1 by insertion, so as to be able to press the spring 36.

As illustrated in FIG. 1, each of the pull-tabs 38 has the grip portion 40 provided at one end thereof and the hook-like shaft portions 39 oppositely provided at the other end thereof. The pull-tabs 38 are formed so as to be able to slide backward and forward by fitting the pull-tab 38 provided at the side of the front surface 10 and the pull-tab 38 provided at the side of the rear surface 11 into the pull-tab guide grooves 21 concavely and respectively provided in the side surfaces of the upper piece 26 and the lower piece 27 of the operating member 20. Incidentally, the pull-tabs 38 are formed so as to have a given shape. A gap is provided in a middle part between the shaft portions 39. The gap has a dimension in the width direction of the associated pull-tab, which is larger than the thickness in the width direction of the associated pull-tab guide groove 21. Thus, each of the pull-tabs 38 is attached to the operating member 20 by sandwiching the part, whose sides are respectively provided with the pull-tab guide grooves 21, by the opposed shaft portions 39 from both sides thereof.

The slider is fabricated as follows. That is, first, the coil-like spring 36 is housed in the spring housing portion 17 provided in the forward surface of the guide post 4 of the body 1. The pawl member 30 is housed in a cavity portion provided in an upper part of the upper plate 2 and the sliding groove 14 provided in a forward side part of the guide post 4. The locking pawl 31 is inserted into the pawl hole 16. The pressing piece 33, which downwardly protrudes as viewed in FIG. 4, is disposed so as to abut against the coil-like spring 36. The pin hole 34 provided in the pawl member 30 is aligned with the pin hole 15 provided in the body 1. The pin 37 is inserted into the holes 15 and 34, so that the pawl member 30 is rotatably supported by the pin 37. In addition, the operating member 20 is put into the body 1 from the side of the shoulder portion 8 to the side of the back portion 9. The sliding concave portion 25 is fit into the sliding groove 14 of the body 1. The projecting piece 32 of the pawl member 30 is inserted into the hole portion 28 provided in the upper piece 26 of the operating member 20. The cross-sectionally T-shaped attaching groove 24 provided in each of the upper piece 26 and the lower piece 27 of the operating member 20 is fit onto an associated one of the cross-sectionally T-shaped projecting portions 12 respectively provided in the upper plate 2 and the lower plate 3. Thus, the operating member 20 is fixed to the body 1. Then, the opposed shaft portions 39 provided at the forward end of each of the pull-tabs 38 are fit into the concave pull-tab guide grooves 21 formed in the side surfaces of an associated one of the upper piece 26 and the lower piece 27 of the operating member 20 so that the pull-tabs 38 can slide backward and forward. Thus, the slider is fabricated so that the operating member 20 can be operated by forward and backward movements of the pull-tabs 38.

In a state in which the slider is fabricated, the pull-tabs 38 are regulated by the forward end portions 22 of the pull-tab guide grooves 21 and the extended part of the body 1 from forwardly moving. Thus, the pull-tabs 38 provided at the front side and the rear side, respectively, are prevented from overlapping with each other. Thus, the forward end of the sliding surface of the extended portion, on which the operating member 20 slides, is located more frontwardly than the forward end portions 22 of the pull-tab guide grooves 21 in a state in which the operating member 20 slides forwardly. The forward end portions 22 and the rear end portions 23 of the pull-tab guide grooves 21 provided in the upper piece 26 and the lower piece 27 are formed so as not to be present in a region closer to the body 1 than the extension of the sliding surface of each of the upper piece 26 and the lower piece 27, on which the slider body 3 slides. That is, the forward end portions 22 and the backward end portions 23 provided in the upper piece are formed so as not to be present in a region closer to the body 1 than the boundary between the upper piece 26, which slides on this boundary, and the projecting ridge portion 13. The forward end portions 22 and the backward end portions 23 provided in the lower piece are formed so as not to be present in a region closer to the body 1 than the boundary between the lower piece 26, which slides on this boundary, and the lower plate 3. Consequently, the forward end portions 22 do not touch the extended part of the body 1 when the operating member 20 slides. Thus, the forward end portions 22 do not hinder the sliding movement of the operating member 20. Incidentally, the forward end of the sliding surface is the position of the forward end part thereof, which is parallel to the upper plate 2 and the lower plate 3.

The slider is used in the following manner. That is, in a case where no pulling force acts upon the pull-tab 38 provided at the side of the front surface 10 and the pull-tab 38 provided at the side of the rear surface 11, the pawl member 30 presses the pressing piece 33 with the elastic force of the spring 36, as illustrated in FIG. 7. Consequently, the locking pawl 31 advances into the element guide groove 6 provided in the body 1. Then, the locking pawl 31 is caught in the fastener element and is stopped in a state in which the slider cannot slide.

Next, when the pull-tab 38 provided at the side of the front surface 10 or the pull-tab 38 provided at the side of the rear surface 11 is pulled toward the backward end portion 23 of the operating member 20 in a state indicated by imaginary lines (i.e., represented by chain double-dashed lines) as illustrated in FIG. 8, the cam portion 29 provided in the operating member 20 presses the pressing piece 33 of the pawl member 30. In addition, the spring 36 is compressed so as to retreat the locking pawl 31 of the pawl member 30 from the element guide groove 6 provided in the body 1, i.e., retreat the locking pawl 31 upwardly, as viewed in FIG. 8. Thus, the slider is slid in a direction in which a fastener chain is opened. Consequently, the fastener chain can be opened.

Alternatively, when the pull-tab 38 provided at the side of the front surface 10 or the pull-tab 38 provided at the side of the rear surface 11 is pulled toward the forward end portion 22 of the operating member 20 in a state 8 indicated by imaginary lines as illustrated in FIG. 9, the projecting piece 32 of the pawl member 30 is pressed by the hole portion 28 provided in the upper piece 26 of the operating member 20. Thus, the pawl member 30 is turned, so that the spring 36 is compressed by the pressing piece 33. Then, the locking pawl 31 is retreated from the element guide groove 6 of the body 1. Thus, the slider is slide in a direction in which the fastener chain is closed. Consequently, the fastener chain can be closed.

An example of using this slider in a tent is described below. As illustrated in FIGS. 10 and 11, a fastener chain is attached to an opening/closing portion 43 of the doorway of a tent 42. At that time, the slider is positioned at a lower place of the tent, so that the fastener chain is attached thereto in a closed state. Even when a person having come out of the tent 42 closes the fastener chain of the opening/closing portion 43 from the outside of the tent 42, a person being present in the tent 42 can open the fastener chain and the opening/closing portion 43 by grasping and upwardly pulling an inside pull-tab 38 of the slider.

In a case where a person being present in the tent 42 closes the fastener chain, a person being present outside the tent 42 can open the fastener chain and the opening/closing portion 43 by grasping and upwardly pulling an outside pull-tab 38 of the slider. Accordingly, the fastener chain can be opened and closed by being operated from the outside and the inside of the tent 42. Thus, the slider according to the invention is very convenient. However, in such a state, the related-art pull-tab turn type slider cannot be utilized.

The slider for a double-sided slide fastener with an automatic locking mechanism according to the invention is used by attaching a fastener chain to a doorway and a window of a tent. The slider can be used for a hood of a truck. The slider can be utilized in goods in each of which a fastener chain is operated individually from the outside and the inside thereof.

According to an aspect of the invention, the pull-tabs are individually attached to the front surface and the rear surface of the operating member. Thus, the slider is convenient in that the slider can be operated utilizing individually the front-side and rear-side pull-tabs. Additionally, the pull-tabs are attached in the pull-tab guide grooves, respectively. The slider includes the forward end portions each of which can abut against the associated shaft portion at the forward side of the associated guide groove. Consequently, the pull-tabs can be configured so that the pull-tabs do not overlap with each other, that the pull-tabs are surely present on both the front side and the rear side, respectively, without being present only on one of the front side and the rear side. Further, the slider is configured so that the operating member slides forward and backward with respect to the body, and that the locking pawl of the locking mechanism is retracted from the element guide groove of the body while following the sliding operation of the operating member. Thus, the locking mechanism can be simplified. Consequently, the locking mechanism can surely achieve an automatic locking function. Especially, in a case where the slider is applied to a tent or the like, even when a fastener chain is closed from the outside of the tent, the fastener chain can be opened from the inside of the tent.

According to an aspect of the invention, because the pull-tabs are cut in the operating member like straight lines in parallel to the upper plate and the lower plate of the body, the pull-tabs are slid linearly along both the front surface and the rear surface of the body. Thus, a pulling force effectively acts upon the forward end or the backward end of the body through the pull-tab consequently, the pulling force can surely slide the body smoothly and surely.

According to an aspect of the invention, the setting position in the anteroposterior direction of the forward end portion of the pull-tab groove on the front side surface is set so as to differ from that in the anteroposterior direction of the forward end portion of the pull-tab groove on the rear side surface. Thus, the forward end part of each of the body and the operating member is shaped so that a front-side part thereof differs in curvature from a rear-side part thereof. The disagreement in the position in the anteroposterior direction between the forward end portion of the pull-tab groove at the front side and the forward end portion of the pull-tab groove at the rear side results in that the pull-tab provided at the front side and the pull-tab provided at the rear side are never arranged at the same position in the anteroposterior direction. Accordingly, the pull-tabs can easily be grasped. Thus, the forward end part of each of can be formed into a streamline shape consequently, the sliding resistance can be reduced.

According to an aspect of the invention, the sliding concave portion having a thickness equal to that of a pull-tab guide groove formed portion is provided at the forward side of the operating member. The sliding concave portion is fit into the sliding groove provided in the body. Thus, the appearance of the forward end side surface of the body can be arranged. Additionally, no gap is formed between the body and the operating member. Consequently, there are no adverse effects of causing another object to bite into the slider. Accordingly, the slider can smoothly slide.

According to an aspect of the invention, because the forward end portions of the pull-tab guide grooves and the sliding concave portion are formed so as to be non-continuously connected to each other. Consequently, the slider does not cause an obstruction that the pull-tabs respectively attached to the front side and the rear side of the body slip out of predetermined raceways. Thus, each of the pull-tabs slides on a normal raceway. Consequently, the pull-tabs can smoothly perform sliding operations.

What is claimed is:

1. A slider for a double-sided slide fastener with an automatic locking device, comprising:

a body, having a first body, a second body opposed to the first body, and a third body connected to the first body and the second body, wherein the first body, the second body, and the third body define a space;

an operating member, attached to the body, and having a first member being parallel to the first body and formed with a first groove and a second member being parallel to the second body and formed with a second groove, the operating member adapted to slide on the first body and the second body in a direction;

a pawl member, being in the body, and having a locking pawl configured to retractably project to the space in accordance with a sliding operation of the operating member;

a first pull-tab, attached to the first groove; and a second pull-tab, attached to the second groove, wherein a shaft portion of the first pull-tab can abut against an end portion of the first groove in the direction, a shaft portion of the second pull-tab can abut against an end portion of the second groove in the direction, a position of the end portion of the first groove and a position of the end portion of the second groove are shifted with each other in the direction, the third body of the body includes a first part close to the first body and a second part close to the second body, the third body has a curved shape and a curvature of the first part and a curvature of the second part is different from each other, the operating member has a third member connected to the first member and the second member, the third member includes a third part close to the first member and a fourth part close to the second member, the third member has a curved shape and a curvature of the third part and a curvature of the fourth part is different from each other;

wherein the third body of the body includes a sliding groove, the operating member has a third member connected to the first member and the second member, the third member includes a sliding concave portion having a thickness substantially equal to that of each of the first and second grooves and adapted to fit into and slide in the sliding groove; and wherein the end portions of the first and second grooves and the sliding concave portion are non-continuously connected to each other.

2. The slider according to claim 1, wherein the first groove has a linear shape and is parallel to the first body, and the second groove has a linear shape and is parallel to the second body.

* * * * *